US005647070A

United States Patent [19]

Yu

[11] Patent Number: 5,647,070

[45] Date of Patent: Jul. 15, 1997

[54] RINSING APPARATUS

[76] Inventor: Sheng-Chung Yu, 2F., No. 1, Lane 151, Hsin Sheng S. Rd., Sec. 1, Taipei, Taiwan

[21] Appl. No.: 571,464

[22] Filed: Dec. 13, 1995

[51] Int. Cl.[6] ..... E03D 9/08

[52] U.S. Cl. ..... 4/420.4; 4/447

[58] Field of Search ..... 4/420.4, 447, 448

[56] References Cited

U.S. PATENT DOCUMENTS

| | | | |
|---|---|---|---|
| 3,430,268 | 3/1969 | Zoberg | 4/447 X |
| 4,559,964 | 12/1985 | Yamaguchi et al. | 4/448 X |
| 4,630,322 | 12/1986 | Kuo | 4/420.4 |
| 5,263,205 | 11/1993 | Leunissen | 4/420.4 |

*Primary Examiner*—Robert M. Fetsuga
*Attorney, Agent, or Firm*—Bacon & Thomas

[57] ABSTRACT

A rinsing apparatus including a housing fixed to the toilet bowl, a water input/output unit mounted within the housing, having a water inlet connected to a water source, a water outlet, a water pressure adjusting hole adjacent to the water inlet, a water pressure adjusting screw threaded into the water pressure adjusting hole and turned to regulate water flowrate passing from the water inlet to the water outlet, a control valve fastened to the water outlet of the water input/output unit to control the passage of the water outlet, a nozzle mount fixedly secured to the toilet seat at the bottom, and a nozzle mounted in the nozzle mount, connected to the water outlet pipe of the control valve, and controlled by the control valve to eject water for rinsing a part of the body of the user who sits on the toilet seat.

3 Claims, 6 Drawing Sheets

RINSING APPARATUS

BACKGROUND OF THE INVENTION

The present invention relates to a rinsing apparatus which is comprised of a housing, a water input/output unit, a nozzle mount, and a nozzle, and installed in the toilet seat of a toilet and controlled to rinse a part of the body of the user who sits on the toilet seat.

Various toilets have been disclosed having a rinsing apparatus for rinsing a part of the body of the user, and have appeared on the market. FIG. 6 shows a toilet having a rinsing apparatus 10 and a control valve 20 for controlling the flow rate of water from the water source to the the rinsing apparatus 10. However, the control valve 20 is not durable in use because it is fastened to the rinsing apparatus 10 by a screw joint and, the threads tend to be damaged with use. Furthermore, the nozzle is integrally made on the rinsing apparatus, and the rinsing apparatus is fixed to the toilet bowl adjacent to the water tank. The nozzle will be retained at the correct position only when the toilet seat is closed on the toilet bowl. If the toilet seat is lifted, the nozzle may be displaced.

SUMMARY OF THE INVENTION

The present invention has been accomplished to provide a rinsing apparatus which eliminates the aforesaid drawbacks.

According to one aspect of the present invention, the rinsing apparatus comprises a housing fixed to the toilet bowl, a water input/output unit mounted within the housing, having a water inlet connected to a water source and a water outlet, a control valve fastened to the water outlet of the water input/output unit to control the passage of the water outlet, a nozzle mount fixedly secured to the toilet seat at the bottom, and a nozzle mounted in the nozzle mount and having a water inlet tube connected to the water outlet pipe of the control valve, the nozzle being controlled by the control valve to eject water for rinsing a part of the body of the user who sits on the toilet seat.

According to another aspect of the present invention, a water pressure adjusting hole is made on the barrel of the water input/output unit adjacent to the water inlet, and a water pressure adjusting screw threaded into the water pressure adjusting hole and turned to regulate water flowrate passing from the water inlet to the water outlet.

According to still another aspect of the present invention, the nozzle mount comprises two downward side walls at two opposite sides, two recessed holes respectively made on the downward side walls at an inner side, which receive two projecting rods of the nozzle, a side opening, a spring element mounted in the side opening and stopped above the water inlet tube of the nozzle, a packing plate fixed to the downward side walls at a bottom side by screws to hold said nozzle in place, the packing plate having a screw hole corresponding to the side opening, and an adjusting screw threaded into the screw hole to stop the water inlet tube of the nozzle against the spring element and turned forwards/backwards to adjust the elevation of the nozzle in the nozzle mount.

DETAILED DESCRIPTION OF THE PREFERRED EMBODIMENT

Figure 1:
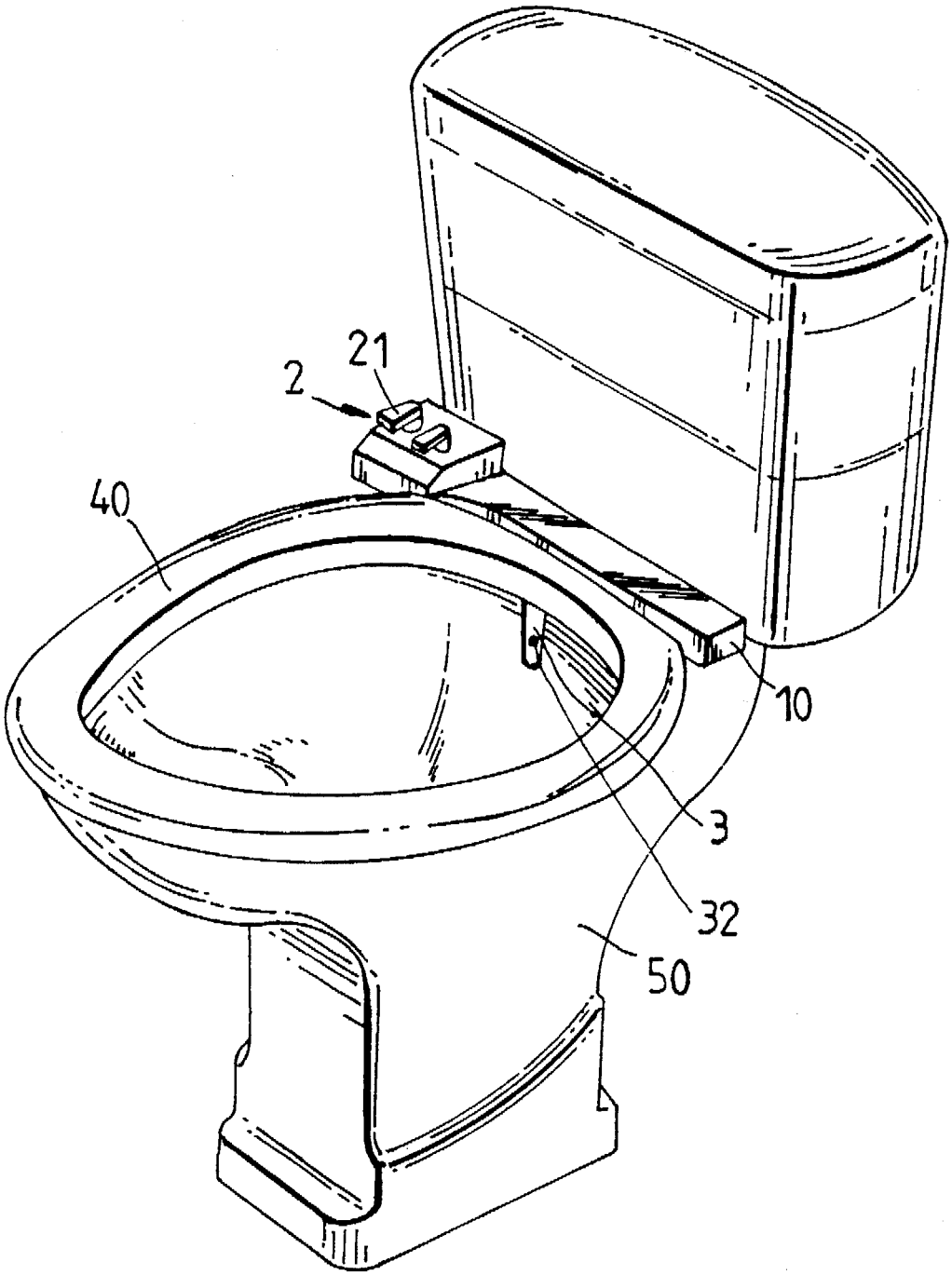
FIG. 1 shows a rinsing apparatus installed in the toilet according to the present invention.

Referring to FIG. 1, a rinsing apparatus in accordance with the present invention is generally comprised of a housing 10, water flowrate control valves 2, and at least one nozzle 3.

Figure 2:
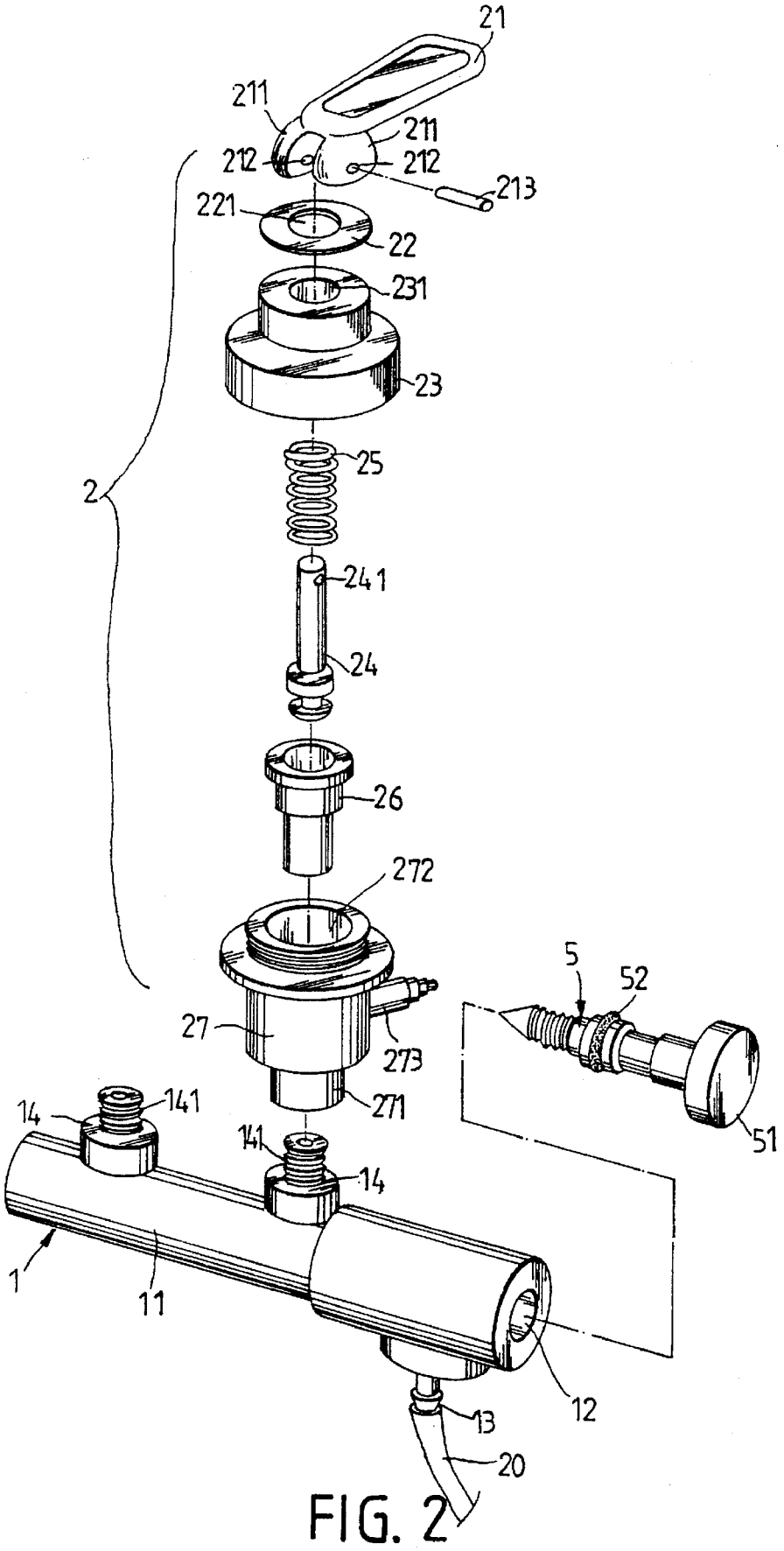
FIG. 2 is an exploded view of a control valve according to the present invention.

Referring to FIG. 2 and FIG. 1 again, a water input/output unit 1 is mounted inside the housing 10, comprising a barrel 11 having a water inlet 13, and at least two water outlets 14. The barrel 1 is made of cylindrical shape having one end closed and an opposite end made with a hole 12. The water inlet 13 is disposed adjacent to the hole 12, and connected to water source by a water supply pipe 20. A water pressure adjusting screw 5 is threaded into the hole 12, having a head 51 at one end disposed outside the housing 10 for turning. A water seal 52 is mounted around the water pressure adjusting screw 5 to seal the hole 12. When the water pressure adjusting screw 5 is threaded into the hole 12 to the limit, the water inlet 13 is stopped by the water pressure adjusting screw 5. By turning the water pressure adjusting screw 5 outwards, the water inlet 13 is gradually opened. Therefore, the pressure of water is regulated by turning the water pressure adjusting screw 5 inwards or outwards. Each of the water outlets 14 has an outer thread 141 for mounting one water flowrate control valve 2. Each of the water flowrate control valves 2 comprises a three-way casing 27, a stopper 26, a stem 24, a spring 25, a cap 23, a stop plate 22, and a lever 21. The three-way casing 27 has an internally threaded bottom end 271 threaded onto the outer thread 141 of one water outlet 14 of the water input/output unit 1, an externally threaded top end 272 coupled to the cap 23, and a side outlet 273 connected to a water outlet pipe 30, which is further connected to one nozzle 3. The cap 23 is fastened to the top end 272 of the three-way casing 27, having a center through hole 231. The stop plate 22 is supported above the cap 23 to limit the vertical turning angle of the lever 21, having a center through hole 221 aligned with the center through hole 231 of the cap 23. The stem 24 is inserted through the center through hole 221 of the stop plate 22 and the center through hole 231 of the cap 23, having a bottom end fastened to the stopper 26 inside the three-way casing 27 and a top end made with a pivot hole 241 and disposed outside the cap 23. The spring 25 is mounted around the stem 24 and stopped between the stopper 26 and the cap 23. The lever 21 has two downward lugs 211 disposed at one end in a parallel relation, each downward lug 211 having a pivot hole 212 respectively connected to the pivot hole 241 of the stem 24 by a pivot 313.

Figure 3:
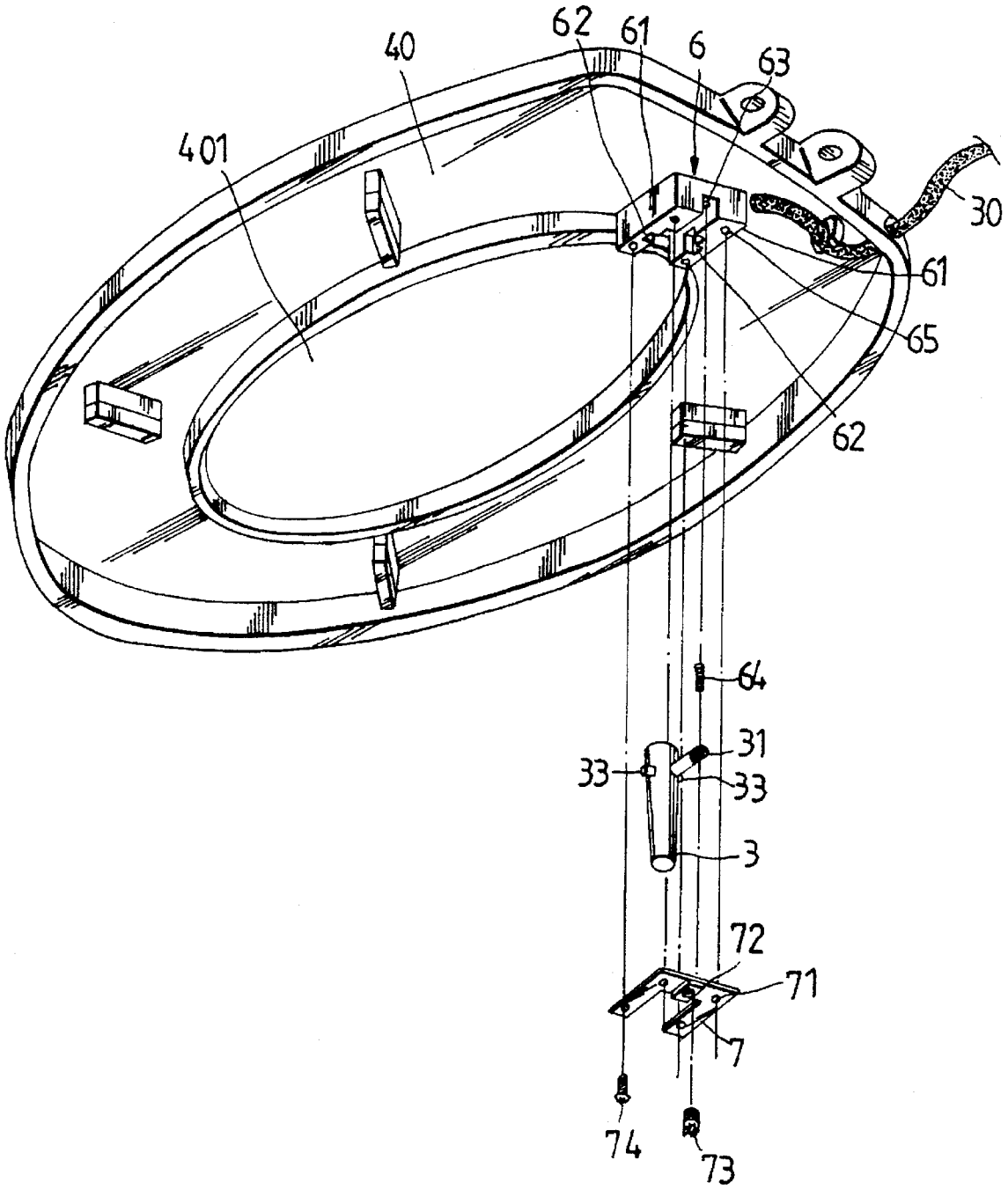
FIG. 3 is an exploded view of the nozzle and the nozzle mount according to the present invention.

Referring to FIG. 3, and FIG. 1 again, the nozzle 3 has a water inlet tube 31 connected to the water outlet pipe 30, at least one jet 32 facing the center opening 401 of the toilet seat 40, and two opposite projecting rods 33. A nozzle mount 6 is fixed to the toilet seat 40 at the bottom side to hold the respective nozzle 3, comprising two downward side walls 61 at two opposite sides, two recessed holes 62 respectively made on the downward side walls 61 at an inner side, a side opening 63, a spring element 64 mounted in the side opening 63, and a plurality of mounting holes 65 vertically disposed through the downward side walls 61. A packing plate 7 is fixed to the nozzle mount 6, having a plurality of mounting holes 71 respectively fastened to the mounting holes 65 of the nozzle mount 6 by a respective screw 74, a screw hole 72 corresponding to the side opening 63 of the nozzle mount 6, and an adjusting screw 73 threaded into the screw hole 72 to stop the water inlet tube 31 against the spring element 64 in the side opening 63 of the nozzle mount 6.

Figure 4:
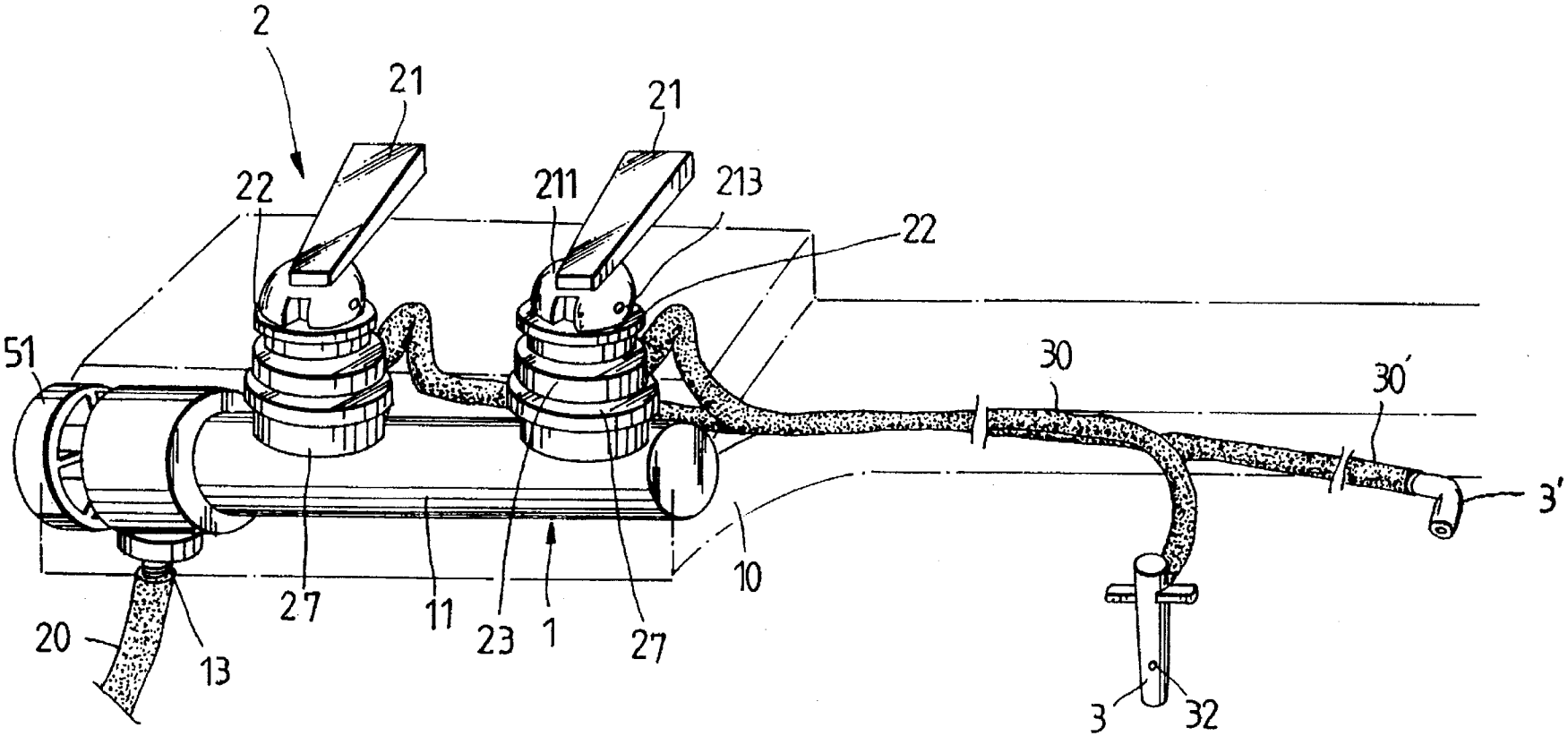
FIG. 4 shows the two control valves installed in the barrel of the water input/output unit according to the present invention.

Referring to FIG. 4 and FIG. 2 again, when the water flowrate control valves 2 are respectively fastened to the water outlets 14 of the water input/output unit 1, the water input/output unit 1 with the water flowrate control valves 2 are then mounted inside the housing 10, permitting the level 21 of each water flowrate control valve 2 to be disposed outside the housing 10, then the water supply pipe 20 is connected to water source, and then the side outlet 273 of the three-way casing 27 is connected to the water outlet pipe 30, which is fixed to the bottom side of the toilet seat 40 and connected to the nozzle 3. Because the embodiment shown in the annexed drawings comprises two water outlets 14, one water outlet pipe 30 is fixedly secured to the toilet seat 40 near the rear end, and the other water outlet pipe 30' is fixedly secured to the toilet seat 40 near the front end, and therefore the nozzles 3, 3' of the two water outlet pipes 30, 30' are respectively controlled to rinse different parts of t he body. When installed, the housing 10 is fixed to the toilet bowl 50.

Figure 5:
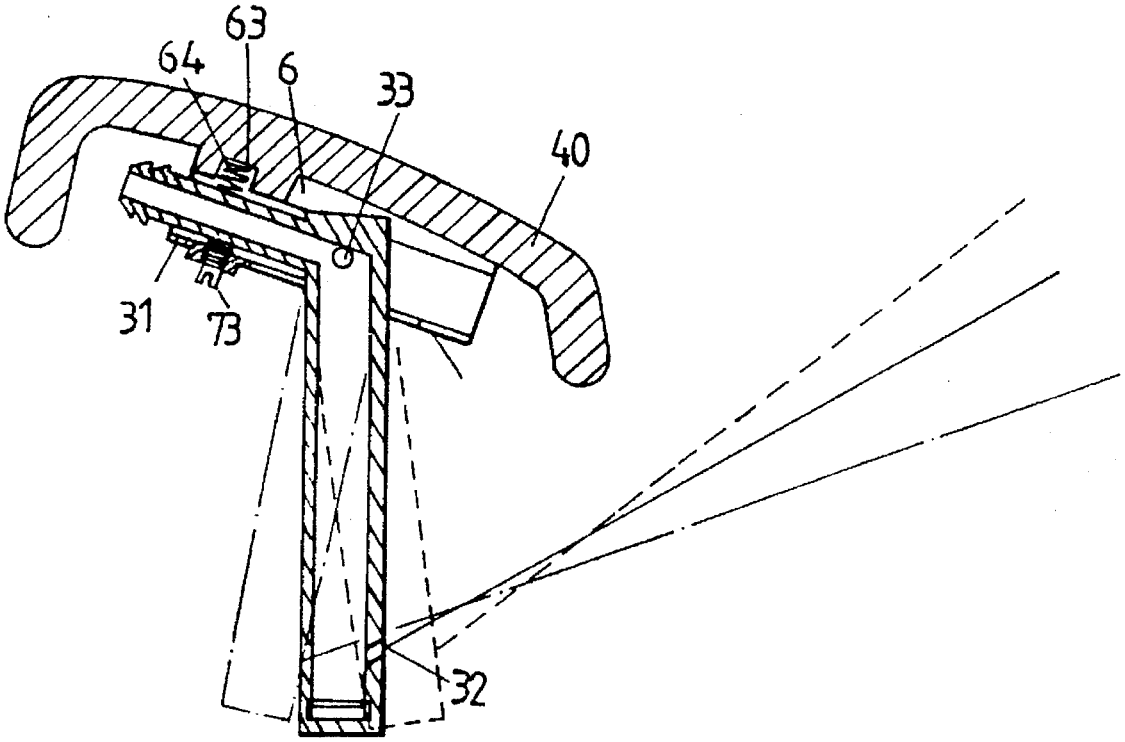
FIG. 5 is a sectional view showing the nozzle operated.
Figure 6:
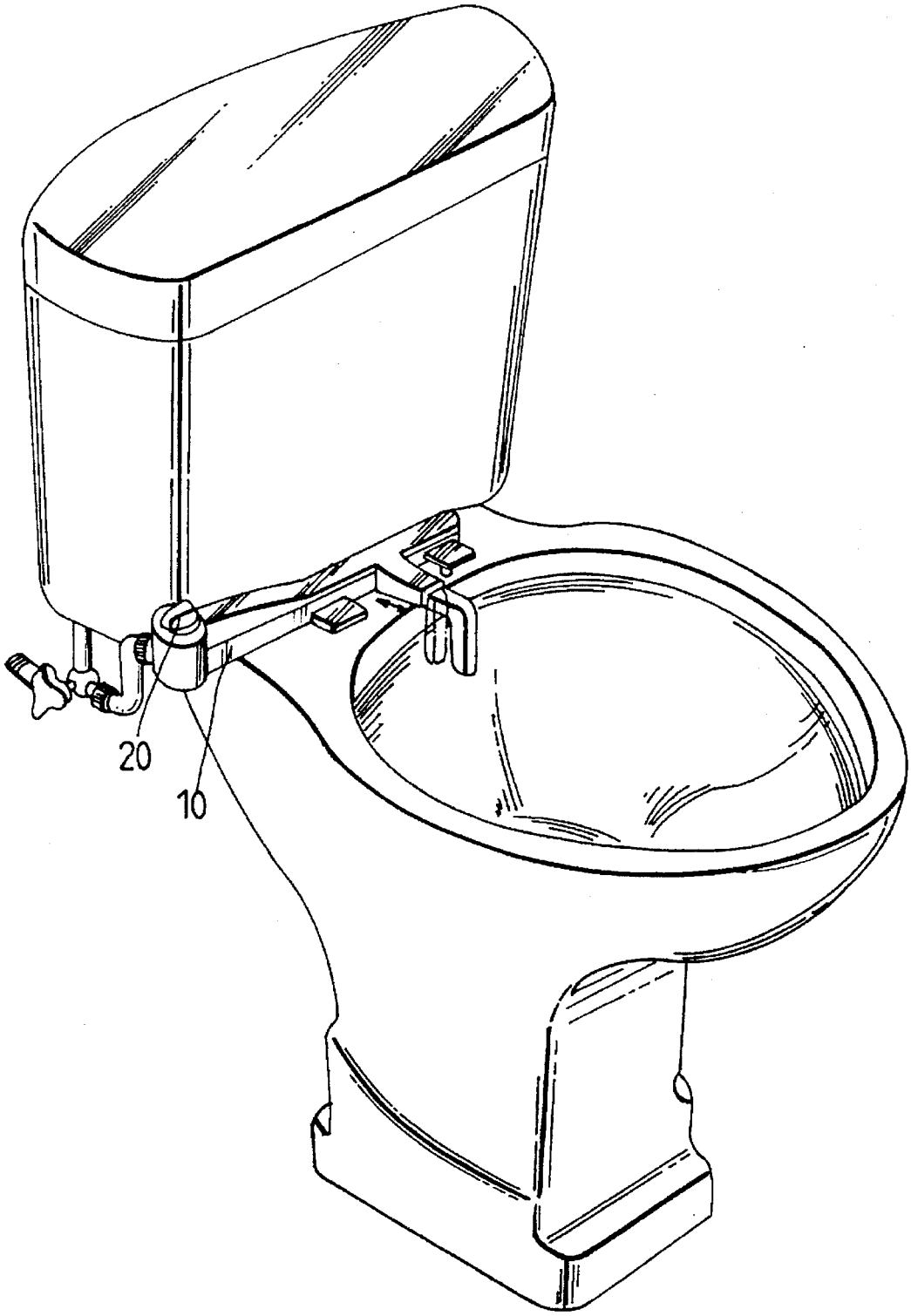
FIG. 6 PRIOR ART
FIG. 6 shows a rinsing apparatus installed in a toilet according to the prior art.

Referring to FIG. 5 and FIG. 3 again, when to install the nozzle 3 to the respective mount 6, the two opposite projecting rods 33 are respectively inserted into the two recessed holes 62 of the downward side walls 61, then the water inlet tube 31 which is connected to the respective water outlet pipe 30 is forced into the side opening 63 and stopped above the spring element 64, then the packing plate 7 is fixed to the nozzle mount 6 by threading the respective screws 74 into the mounting holes 71 of the packing plate 7 and the mounting holes 65 of the downward side walls 61, and then the adjusting screw 73 is threaded into the screw hole 72 of the packing plate 7 and stopped against the water outlet tube 31. By turning the adjusting screw 73 forwards or backwards, the elevation of the water inlet tube 31 of the nozzle 3 is adjusted, and therefore the position of the nozzle 3 is relatively adjusted.

Referring to FIG. 4 again, the levers 21 of the two control valves 2 may be colored with different colors so that they can be easily distinguished from each other. When in use, the pressure of water is regulated to the desired level by turning the water pressure adjusting screw 5 forwards or backwards. When the lever 21 of one control valve 2 is pulled upwards or turned downwards, the respective stem 24 is lifted to carry the stopper 26 upwards from the bottom of the respective three-way casing 27 for permitting water to flow from the respective water outlet 14 to the respective water outlet pipe 30 and the respective nozzle 3, and therefore water is ejected from the jet(s) 32 of the respective nozzle 3 to rinse a part of the body of the user who sits on the toilet seat 40. Because the lever 21 can be turned through 360° horizontally relative to the cap 23, it can be turned to the suitable position for easy operation by the user.

While only one embodiment of the present invention has been shown and described, it will be understood that various modifications and changes could be made without departing from the spirit and scope of the invention disclosed.

I claim:

1. A rinsing apparatus for use with a toilet including a bowl and a seat, comprising:

a housing securable to the toilet bowl adjacent to the toilet seat and defining a receiving chamber;

a water input/output unit mounted within the receiving chamber of said housing, said water input/output unit comprising a barrel having a water inlet, a water outlet, a water pressure adjusting hole adjacent to said water inlet, a water pressure adjusting screw threaded into said water pressure adjusting hole and turned to regulate water flowrate passing from said water inlet to said water outlet;

a control valve fastened to the water outlet of said water input/output unit to control the passage water from said water outlet, said control valve comprising a three-way casing, a stopper, a stem, a spring, a cap, a stop plate, and a lever, said three-way casing having an internally threaded bottom end threaded onto an outer thread on the water outlet of said water input/output unit, an externally threaded top end connected to said cap, and a side outlet connected to a water outlet pipe, said cap being fastened to the top end of said three-way casing and having a center through hole, said stop plate being supported above said cap to limit the vertical turning angle of said lever and having a center through hole aligned with the center through hole of said cap, said stem being inserted through the center through hole of said stop plate and the center through hole of said cap and having a bottom end fastened to said stopper inside said three-way casing and a top end made with a pivot hole and disposed outside said cap, said spring being mounted around said stem and stopped between said stopper and said cap, said lever having two downward lugs disposed at one end in a parallel relation and bilaterally connected to the pivot hole of said stem by a pivot;

a nozzle mount securable to the toilet seat of said toilet at a bottom side; and a nozzle mounted in said nozzle mount, said nozzle having a water inlet tube connected to the water outlet pipe of said control valve, at least one jet facing the center opening of the toilet seat of said toilet, and two opposite projecting rods fastened to said nozzle mount.

2. The rinsing apparatus of claim 1 further comprising a water seal ring mounted around said water pressure adjusting screw within said water pressure adjusting hole to seal the gap between said barrel and said water pressure adjusting screw.

3. The rinsing apparatus of claim 1 wherein said nozzle mount comprises two downward side walls at two opposite sides, two recessed holes respectively made on said downward side walls at an inner side, which receive the two projecting rods of said nozzle, a side opening, a spring element mounted in said side opening and stopped above the water inlet tube of said nozzle, a packing plate fixed to said downward side walls at a bottom side by screws to hold said nozzle in place, said packing plate having a screw hole corresponding to said side opening, and an adjusting screw threaded into said screw hole to stop the water inlet tube of said nozzle against said spring element and turned forwards/backwards to adjust the elevation of said nozzle in said nozzle mount.

* * * * *